US008369762B2

(12) United States Patent
Okabayashi et al.

(10) Patent No.: US 8,369,762 B2
(45) Date of Patent: Feb. 5, 2013

(54) HEATING DEVICE INCLUDING A HEATING MEMBER, A PRESSURE MEMBER, A TENSIONING MEMBER, AND AN INSIDE HEATING UNIT, AND AN IMAGE FORMING APPARATUS

(75) Inventors: Yasuto Okabayashi, Ebina (JP); Kouichi Kimura, Ebina (JP); Mizuki Sugino, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 272 days.

(21) Appl. No.: 12/844,213

(22) Filed: Jul. 27, 2010

(65) Prior Publication Data

US 2011/0135357 A1 Jun. 9, 2011

(30) Foreign Application Priority Data

Dec. 9, 2009 (JP) ..... 2009-279467

(51) Int. Cl.
*G03G 15/20* (2006.01)

(52) U.S. Cl. ..... 399/330; 399/329; 219/216

(58) Field of Classification Search ..... 399/323, 399/328, 329; 339/330; 219/216
See application file for complete search history.

(56) References Cited

U.S. PATENT DOCUMENTS

| | | | | |
|---|---|---|---|---|
| 4,538,052 | A * | 8/1985 | Asanuma et al. | 219/469 |
| 4,736,226 | A * | 4/1988 | Mogi | 399/122 |
| 5,301,000 | A * | 4/1994 | Heigl | 399/122 |
| 5,832,354 | A * | 11/1998 | Kouno et al. | 399/330 |
| 6,442,360 | B1 * | 8/2002 | Onodera et al. | 399/122 |
| 6,993,280 | B2 * | 1/2006 | Alberstadt et al. | 399/330 |
| 2007/0048035 | A1 * | 3/2007 | Baba et al. | 399/323 |

FOREIGN PATENT DOCUMENTS

JP 09-305058 A 11/1997

* cited by examiner

*Primary Examiner* — David Gray
*Assistant Examiner* — G. M. Hyder
(74) *Attorney, Agent, or Firm* — Sughrue Mion, PLLC

(57) ABSTRACT

A heating device includes: a heating member heating a recording medium; a pressure member forming a heating pressure portion with the heating member, through which the recording medium passes; a tensioning member facing the pressure member across the heating member, and providing a tension to the heating member; a peeling member placed downstream of the heating pressure portion and adjacent to the tensioning member, and peeling off the recording medium from the heating member; and an inside heating unit heating the heating member and controlling meandering of the heating member, the inside heating unit including: a secured center shaft; an outer circumferential portion rotating about the center shaft; a heater placed inside the outer circumferential portion to heat thereof from inside; and a heat reflecting member secured to the center shaft and placed at each end portion of the outer circumferential portion, and that reflects heat from the heater.

17 Claims, 5 Drawing Sheets

HEATING DEVICE INCLUDING A HEATING MEMBER, A PRESSURE MEMBER, A TENSIONING MEMBER, AND AN INSIDE HEATING UNIT, AND AN IMAGE FORMING APPARATUS

CROSS REFERENCE TO RELATED APPLICATIONS

This application is based on and claims priority under 35 USC §119 from Japanese Patent Application No. 2009-279467 filed Dec. 9, 2009.

BACKGROUND

1. Technical Field

The present invention relates to a heating device and an image forming apparatus.

2. Related Art

There has been known, as a fixing device used for an image forming apparatus such as a copying machine and a printer, a device including a heating member configured with a belt member (a fixing belt) that is provided with a tension by plural rolls.

SUMMARY

According to an aspect of the present invention, there is provided a heating device including: a heating member that heats a recording medium; a pressure member that forms a heating pressure portion between the pressure member and the heating member by coming into pressure contact with an outer circumferential surface of the heating member, the heating pressure portion being passed through by the recording medium; a tensioning member that is placed facing the pressure member with the heating member interposed therebetween, and that provides a tension to the heating member; a peeling member that is placed in a region downstream of the heating pressure portion, in a direction in which the recording medium proceeds, at a position adjacent to the tensioning member, and that peels off the recording medium from the heating member; and an inside heating unit that heats the heating member from inside and that controls meandering of the heating member, the inside heating unit including: a secured center shaft; an outer circumferential portion that rotates about the center shaft; a heater that is placed inside the outer circumferential portion, and that heats the outer circumferential portion from inside; and a heat reflecting member that is secured to the center shaft and placed at each of both end portions of the outer circumferential portion, and that reflects heat emitted from the heater.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the attached drawings.

<Description of Image Forming Apparatus>

Figure 1:
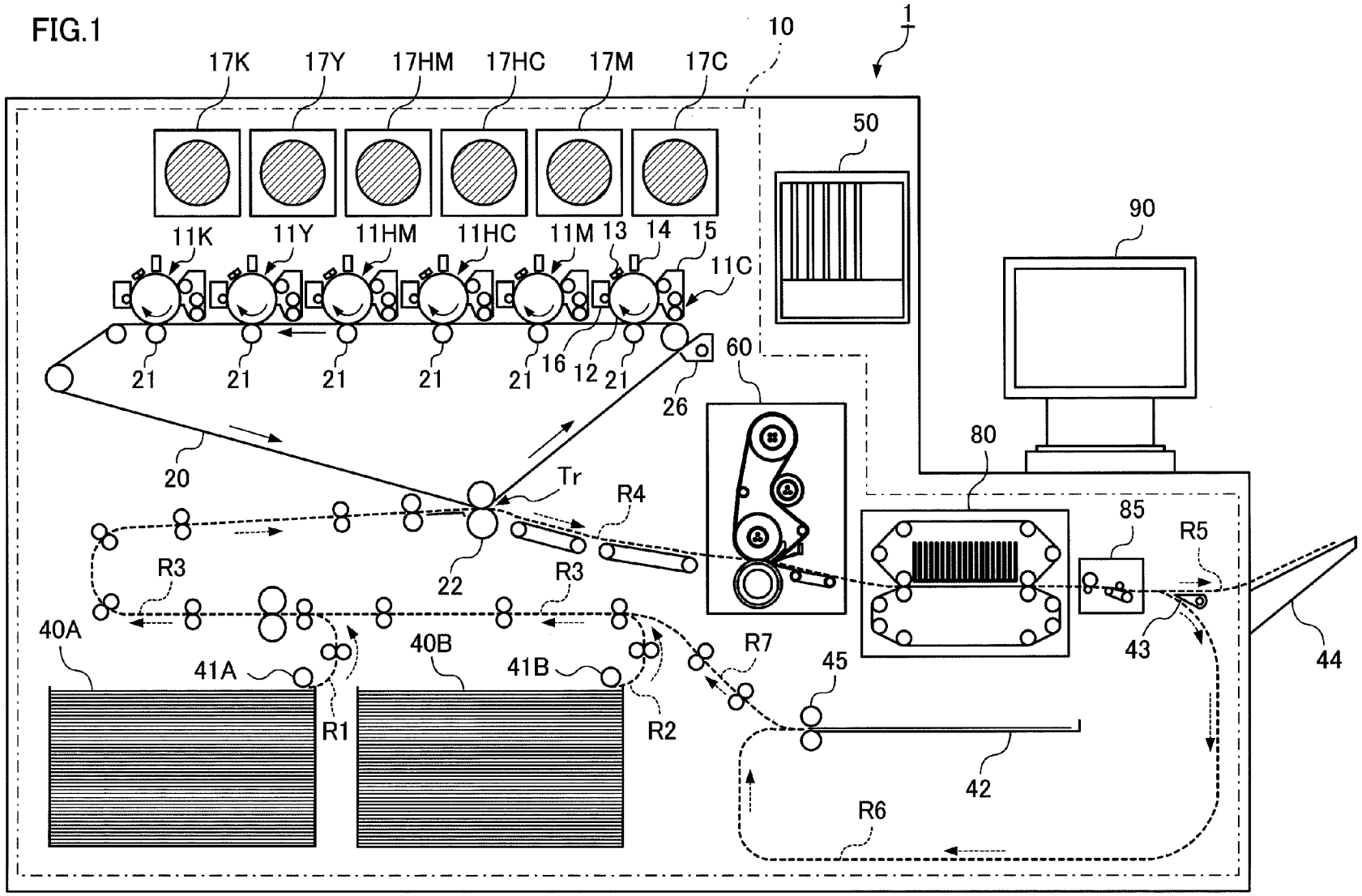
FIG. 1 illustrates a configuration example of an image forming apparatus employing a fixing unit according to an exemplary embodiment.

FIG. 1 illustrates a configuration example of an image forming apparatus 1 employing a fixing unit (fixing device) 60 according to the exemplary embodiment. The image forming apparatus 1 shown in FIG. 1 is a so-called "tandem-type" color printer, and includes: an image forming portion 10 that forms an image based on image data; a main controller 50 that performs overall control of operations of the image forming apparatus 1, communication with, for example, a personal computer (PC) or the like, image processing for image data, and the like; and a user interface (UI) portion 90 that receives an operation input from a user and displays various kinds of information to the user.

<Description of Image Forming Portion>

The image forming portion 10 is a functional portion for forming an image using for example, an electrophotographic system, and includes six image forming units 11C, 11M, 11HC, 11HM, 11Y, 11K (hereinafter, referred to as "image forming units 11") arranged in parallel, provided as an example of a toner image forming unit. As functional members, each image forming unit 11 includes, for example, a photoconductive drum 12, a charging device 13, an exposure device 14, a developing device 15, and a cleaner 16. On the photoconductive drum 12, an electrostatic latent image is formed, and then a toner image of a certain color is formed. The charging device 13 charges the surface of the photoconductive drum 12 at a predetermined potential. Based on image data, the exposure device 14 exposes the photoconductive drum 12 charged by the charging device 13. The developing device 15 develops the electrostatic latent image formed on the photoconductive drum 12 by toner of the certain color. The cleaner 16 cleans the surface of the photoconductive drum 12 after transfer.

The developing device 15 of each image forming unit 11 is connected, through a toner supply path (not shown), to a corresponding one of toner containers 17C, 17M, 17HC, 17HM, 17Y, 17K (hereinafter, referred to as "toner containers 17") storing toner of respective colors. The toner containers 17 replenish the developing devices 15 with toner of respective colors using replenishment screws (not shown) provided in the toner supply paths.

The image forming units 11 have almost the same configuration except for the color of toner contained in the developing devices 15. The image forming units 11 form toner images of cyan (C), magenta (M), highly saturated cyan (HC), highly saturated magenta (HM), yellow (Y), and black (K), respectively. Here, HC is cyan having a cyan hue and having a brighter color tone and a higher saturation than C. HM is magenta having a magenta hue and having a brighter color tone and a higher saturation than M.

In addition, the image forming portion 10 includes: an intermediate transfer belt 20 on which the toner images of the respective colors formed on the photoconductive drums 12 of the image forming units 11 are transferred; and primary transfer rolls 21 that transfer the toner images of the respective colors formed on the photoconductive drums 12 of the image forming units 11 onto the intermediate transfer belt 20 (primary transfer). The image forming portion 10 further includes: secondary transfer roll 22 that collectively transfers the toner images of the respective colors that have been transferred onto the intermediate transfer belt 20 in an superimposed manner onto a sheet being a recording medium (secondary transfer); and the fixing unit 60, as an example of a heating device, that fixes the toner images of the respective colors after the secondary transfer onto the sheet.

In addition, the image forming portion 10 includes: a cooling unit 80 that cools the toner images of the respective colors fixed onto the sheet by the fixing unit 60 so that toner images of the respective colors are more securely fixed onto the sheet; and a curl correction unit 85 that corrects a curl in the sheet.

Note that in the image forming apparatus 1 of the exemplary embodiment, a transfer unit is formed of the intermediate transfer belt 20, the primary transfer rolls 21, and the secondary transfer roll 22. Further, an area where the secondary transfer roll 22 is placed and where the toner images of the respective colors on the intermediate transfer belt 20 are transferred onto the sheet through the secondary transfer is hereinafter referred to as "secondary transfer area Tr."

<Description of Sheet Transport System>

As a sheet transport system, the image forming portion 10 includes: multiple (two in the exemplary embodiment) sheet containers 40A and 40B that hold sheets; pick-up rolls 41A and 41B that pick up a sheet held in the sheet containers 40A and 40B, respectively, and transport the sheet; a first transport path R1 for transporting the sheet from the sheet container 40A; and a second transport path R2 for transporting the sheet from the sheet container 40B. The image forming portion 10 further includes a third transport path R3 for transporting the sheet from the sheet container 40A or 40B toward the secondary transfer area Tr. Moreover, the image forming portion 10 includes: a fourth transport path R4 for transporting the sheet onto which the toner images of the respective colors are transferred at the secondary transfer area Tr, so that the sheet passes the fixing unit 60, the cooling unit 80, and the curl correction unit 85; and a fifth transport path R5 for transporting the sheet from the curl correction unit 85 toward a sheet stacking portion 44 provided at an exit portion of the image forming apparatus 1.

Transport rolls and transfer belts are arranged along the first transport path R1 to the fifth transport path R5, sequentially transporting a sheet being fed.

<Description of Duplex Transport System>

As a duplex transport system, the image forming portion 10 includes:

an intermediate sheet container 42 that temporarily holds the sheet having a first surface onto which the toner images of the respective colors are fixed; a sixth transport path R6 for transporting the sheet from the curl correction unit 85 toward the intermediate sheet container 42; and a seventh transport path R7 for transporting the sheet held in the intermediate sheet container 42 toward the third transporting path R3 described above. The image forming portion 10 further includes: a switching mechanism 43 that is placed downstream of the curl correction unit 85 in a sheet transport direction, and that selectively switches the transport direction of the sheet between the fifth transport path R5 for transporting the sheet toward the sheet stacking portion 44 and the sixth transport path R6 for transporting the sheet toward the intermediate sheet container 42; and pick-up rolls 45 that pick up the sheet held in the intermediated container 42 and transport the sheet toward the seventh transport path R7.

<Description of Image Forming Operations>

Next, a description is given of basic image forming operations of the image forming apparatus 1 according to the exemplary embodiment.

The image forming units 11 of the image forming portion 10 form toner images of colors of C, M, HC, HM, Y, and K, respectively, by an electrophotographic process using the above-described functional members. The primary transfer rolls 21 sequentially transfer the toner images of the respective colors formed on the respective image forming units 11 onto the intermediate transfer belt 20 (primary transfer) to form a composite toner image in which the toner images of the respective colors are superimposed on one another. Along with the movement of the intermediate transfer belt 20 (arrow direction), the composite toner image on the intermediate transfer belt 20 is transported to the secondary transfer area Tr where the secondary transfer roll 22 is placed.

Meanwhile, in the sheet transport system, according to the timing at which the image forming units 11 start image formation, the pick-up roll 41A or 41B rotates and picks up a sheet from the sheet container 40A or 40B, whichever is designated by the UI portion 90, for example. The sheet picked up by the pick-up roll 41A or 41B is transported along the first transport path R1 or the second transport path R2 and then along the third transport path R3, and reaches the secondary transfer area Tr.

In the secondary transfer area Tr, the composite toner image held on the intermediate transfer belt 20 is collectively transferred to the sheet by a transfer electric field formed by the secondary transfer roll 22 (secondary transfer).

Thereafter, the sheet to which the composite toner image is transferred is separated from the intermediate transfer belt 20 and is transported to the fixing unit 60 along the fourth transport path R4. The composite toner image on the sheet transported to the fixing unit 60 is subjected to a fixing process by the fixing unit 60 and is thus fixed onto the sheet. Then, the sheet having the fixed image formed thereon is cooled by the cooling unit 80, and a curl of the sheet is then corrected by the curl correction unit 85. After that, in a simplex printing mode, the sheet having passed the curl correction unit 85 is led by the switching mechanism 43 to the fifth transport path R5 and is transported toward the sheet stacking portion 44.

Note that the cleaners 16 remove toner attached to the photoconductive drums 12 after the primary transfer (residual toner after primary transfer), and a belt cleaner 26 removes toner attached to the intermediate transfer belt 20 after the secondary transfer (residual toner after secondary transfer).

In a duplex printing mode, on the other hand, the sheet having the first surface onto which the image is fixed by the above described process passes the curl correction unit 85 and then is led by the switching mechanism 43 to the sixth transport path R6 to be transported to the intermediate sheet container 42. Then, according to the timing at which the image forming units 11 start image formation on a second surface of the sheet, the pick-up rolls 45 rotate and pick up the sheet from the intermediate sheet container 42. The sheet picked up by the pick-up rolls 45 is transported along the seventh transport path R7 and the third transport path R3, and reaches the secondary transfer area Tr.

In the secondary transfer area Tr, as in the case of the first surface, the composite toner image for the second surface held on the intermediate transfer belt 20 is collectively transferred onto the sheet by a transfer electric field formed by the secondary transfer roll 22 (secondary transfer).

Then, as in the case of the first surface, the sheet having the toner image transferred on both surfaces undergoes fixing at the fixing unit 60, is cooled by the cooling unit 80, and a curl of the sheet is corrected by the curl correction unit 85. After that, the sheet having passed the curl correction unit 85 is led by the switching mechanism 43 to the fifth transport path R5 and is transported toward the sheet stacking portion 44.

In a manner described above, the cycle of the image formation process of the image forming apparatus 1 is repeated in cycles for the number of prints to be produced.

<Description of Fixing Unit Configuration>

Next, a description is given of the fixing unit 60 used in the image forming apparatus 1 of the exemplary embodiment.

Figure 2:
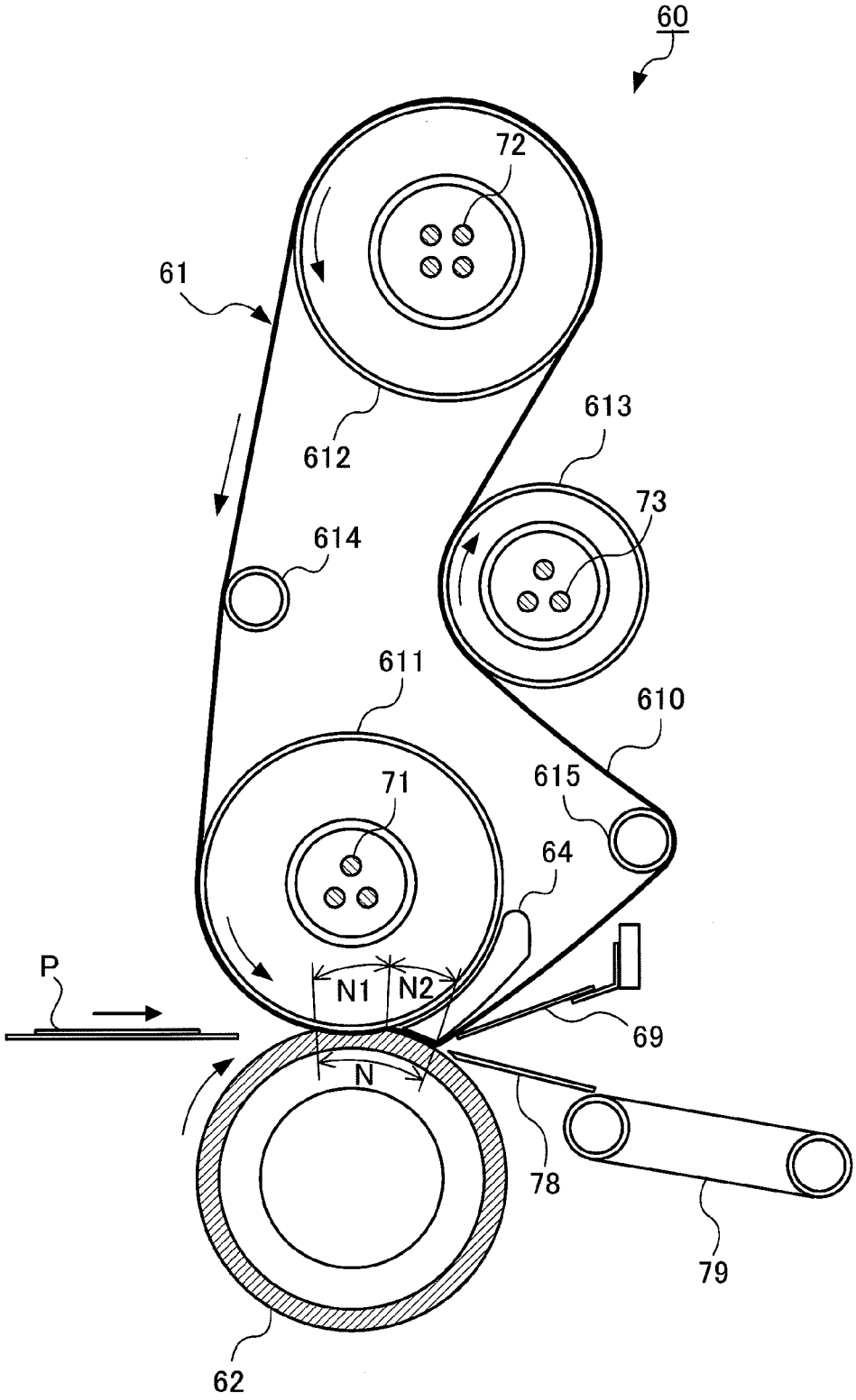
FIG. 2 is a cross-sectional view illustrating the configuration of the fixing unit of the exemplary embodiment.

FIG. 2 is a cross-sectional view illustrating the configuration of the fixing unit 60 of the exemplary embodiment. As main parts, the fixing unit 60 includes a fixing belt module 61 and a pressure roll 62. The pressure roll 62 is an example of a pressure member configured to be contactable with and separable from the fixing belt module 61.

The fixing belt module 61 includes a fixing belt 610, a fixing roll 611, an inside heating roll 612, and an outside heating roll 613. The fixing belt 610 is an example of a heating member that fixes a toner image on a sheet P. The fixing roll 611 is a tensioning member that is placed facing the pressure roll 62 with the fixing belt 610 interposed therebetween and that rotates while providing a tension to the fixing belt 610. The fixing roll 611 heats the fixing belt 610 from inside at a nip portion (heating pressure portion) N which is an area where the fixing belt module 61 and the pressure roll 62 are in pressure contact with each other (in contact while pressing each other). The inside heating roll 612 is an example of an inside heating unit that heats the fixing belt 610 while providing a tension to the fixing belt 610 from inside. The outside heating roll 613 is an example of an outside heating portion that heats the fixing belt 610 while providing a tension to the fixing belt 610 from outside. The fixing belt module 61 also includes a tensioning roll 614, a peeling pad 64, and a tensioning roll 615. The tensioning roll 614 provides a tension to the fixing belt 610 between the fixing roll 611 and the inside heating roll 612 (upstream of nip portion N). The peeling pad 64 is an example of a peeling member placed downstream of the nip portion N and adjacent to the fixing roll 611. The tensioning roll 615 provides a tension to the fixing belt 610, downstream of the nip portion N.

The fixing belt 610 is formed of a base layer made of, for example, a polyimide resin, an elastic layer stacked on a surface side (outer circumferential side) of the base layer and made of a silicon rubber, and a release layer covering the elastic layer and made of a PFA (tetrafluoroethylene-perfluoro alkyl vinyl ether copolymer resin). Here, the elastic layer is provided particularly to improve the quality of color images. Specifically, a toner image held on the sheet P, which is to be fixed later, is formed by laminating powder toners of respective colors. For this reason, to apply heat uniformly to the entire toner image at the nip portion N, the surface of the fixing belt 610 may desirably change shape according to the surface unevenness of the toner image on the sheet P.

The fixing roll 611 is a cylindrical roll formed of aluminum or SUS, for example, and rotates in a direction shown by an arrow in FIG. 2 by a rotational driving force of a drive motor (not shown). Then, the fixing roll 611 is heated to a predetermined temperature (e.g., 150° C.) by for example three halogen heaters 71 placed inside the fixing roll 611 as a heating source.

The inside heating roll 612 is a cylindrical roll formed of aluminum or SUS, for example. The fixing roll 612 is heated to a predetermined temperature (e.g., 190° C.) by for example four halogen heaters 72 placed inside as a heating source.

Further, at both end portions, the inside heating roll 612 is provided with spring members (not shown) that press the fixing belt 610 from inside to outside, setting the overall tension of the fixing belt 610 to, for example, 15 kgf.

The inside heating roll 612 is further provided with a mechanism for controlling meandering (belt walk) of the fixing belt 610. Specifically, a belt edge position detecting mechanism (not shown) is provided near the inside heating roll 612 to detect the position of an edge of the fixing belt 610. The inside heating roll 612 is further provided with a displacement mechanism (not shown) for displacing one of edge portions of the inside heating roll 612 in a direction orthogonal to an axis direction of the inside heating roll 612. The displacement mechanism displaces the fixing belt 610 in the axis direction of the inside heating roll 612 by displacing one of the edge portions of the inside heating roll 612 according to a detection result of the belt edge position detecting mechanism. The belt walking of the fixing belt 610 is thus controlled.

The outside heating roll 613 is a cylindrical roll formed of aluminum or SUS, for example. The outside heating roll 613 is heated to a predetermined temperature (e.g., 190° C.) by for example three halogen heaters 73 placed inside as a heating source.

As described, the fixing unit 60 of the exemplary embodiment employs a configuration in which the fixing belt 610 is heated by the fixing roll 611, the inside heating roll 612, and the outside heating roll 613.

The peeling pad 64 is a block member having a substantially arc-shaped cross section and being formed of a rigid body such as a metal like SUS or a resin. Over the entire area of the fixing roll 611 in the axis direction, the peeling pad 64 is placed to be secured at a position downstream of and adjacent to an area where the pressure roll 62 is in pressure contact with the fixing roll 611 with the fixing belt 610 interposed therebetween (hereinafter, referred to as "roll nip portion Ni"). The peeling pad 64 is installed to evenly press an area of a predetermined width (e.g., a 5-mm nip width in a traveling direction of the fixing belt 610) of the pressure roll 62 with the fixing belt 610 interposed therebetween with a predetermined load (e.g., 10 kgf average). The peeling pad 64 forms a "peeling pad nip portion N2" next to the roll nip portion N1.

The pressure roll 62 is a member that forms the nip portion N between itself and the fixing belt 610 by being pressed against the outer circumferential surface of the fixing belt 610. The nip portion N is where the sheet P holding an unfixed toner image passes. For example, the pressure roll 62 has a cylindrical roll formed of aluminum or SUS as a base on which an elastic layer formed of a silicon rubber and a release layer formed of a PFA tube are sequentially laminated in this order. The pressure roll 62 is placed to be contactable with and separable from the fixing belt module 61. When in contact (pressure contact) with the fixing belt module 61 while pressing thereagainst, the pressure roll 62 rotates in a direction shown by an arrow, driven by the fixing roll 611 of the fixing belt module 61 rotating in another direction shown by an arrow.

<Description of Fixing Operations of Fixing Unit>

Next, a description is given of fixing operations of the fixing unit 60 of the exemplary embodiment.

The sheet P on which a composite toner image (unfixed toner image) is electrostatically transferred at the secondary transfer area Tr (refer to FIG. 1) of the image forming apparatus 1 is transported toward the nip portion N (refer to FIG. 2) of the fixing unit 60 along the fourth transport path R4 (refer to FIG. 1). Then, the unfixed toner image held on the surface of the sheet P passing the nip portion N is fixed onto the sheet P by pressure and heat acting mainly on the roll nip portion N1.

Specifically, in the fixing unit 60 of the exemplary embodiment, heat acting on the roll nip portion Ni is supplied mainly by the fixing belt 610. The fixing belt 610 is heated by: heat supplied through the fixing roll 611 from the halogen heaters 71 placed inside the fixing roll 611; heat supplied through the fixing roll 612 from the halogen heaters 72 placed inside the fixing roll 612; and heat supplied through the fixing roll 613 from the halogen heaters 73 placed inside the fixing roll 613. Thus, heat energy is supplied from not only the fixing roll 611, but also the inside heating roll 612 and the outside heating roll 613. Consequently, a sufficient amount of heat may be obtained in the roll nip portion N1 even at a high process speed.

In the fixing unit 60 of the exemplary embodiment, the fixing belt 610 functioning as a direct-heating member may be configured with an extremely small heat capacity. In addition, the fixing belt 610 is configured to be in contact with each of the heat supplying members, the fixing roll 611, the inside heating roll 612, and the outside heating roll 613, with a large wrap area (a large wrap angle). Consequently, the sufficient amount of heat is supplied from the fixing roll 611, the inside heating roll 612, and the outside heating roll 613 in a short cycle in which the fixing belt 610 rotates one revolution. Accordingly, it takes only a short time for the fixing belt 610 to regain a temperature capable of fixing. Thereby, a predetermined fixing temperature is maintained at the roll nip portion N1.

As a result, even when sheets pass the fixing unit 60 of the exemplary embodiment successively at a high speed, the fixing unit 60 keeps its fixing temperature almost constant. Moreover, occurrence of a phenomenon in which the fixing temperature drops upon initiation of high-speed fixing operations (so-called "temperature droop phenomenon") is prevented. In particular, even in fixing to a thick sheet or the like requiring a large heat capacity, the fixing temperature is maintained and occurrence of the temperature droop phenomenon is prevented. Furthermore, because the fixing belt 610 has a small heat capacity, when the fixing temperature needs to be changed in the middle of the operations, depending on a sheet type (increasing and decreasing of the fixing temperature), the fixing temperature is easily changeable by adjusting outputs of the halogen heaters 71, the halogen heaters 72, and the halogen heaters 73.

Further, in the fixing unit 60 of the exemplary embodiment, the fixing roll 611 is a hard roll formed of aluminum, SUS, or the like, and the pressure roll 62 is a soft roll covered with an elastic layer. Accordingly, a nip area having a certain width in the traveling direction of the fixing belt 610 is formed in the roll nip portion N1, where the fixing roll 611 hardly deforms, while the surface of the pressure roll 62 deforms. As described, the side of the fixing roll 611 which is wrapped by the fixing belt 610 hardly changes shape in the roll nip portion N1. For this reason, the fixing belt 610 passes the roll nip portion N1 while keeping the moving speed almost constant. This prevents the fixing belt 610 from creasing or being deformed in the roll nip portion N1, so that a fixed image of good quality may be provided.

Subsequently, after passing the roll nip portion N1, the sheet P is transported to the peeling pad nip portion N2. In the peeling pad nip portion N2, the peeling pad 64 is pressed against the pressure roll 62, and the fixing belt 610 is in pressure contact with the pressure roll 62. Accordingly, the roll nip portion N1 has a shape curving downward due to the curvature of the fixing roll 611, whereas the peeling pad nip portion N2 has a shape curving upward due to the curvature of the pressure roll 62.

Accordingly, the sheet P heated and pressed under the curvature of the fixing roll 611 in the roll nip portion N1 changes its traveling direction in the peeling pad nip portion N2 according to the curvature of the pressure roll 62 which is curved in an opposite direction. In this direction change, an extremely little slippage occurs between the toner image on the sheet P and the surface of the fixing belt 610. Thereby, adhesion between the toner image and the fixing belt 610 weakens, facilitating the sheet P to be peeled off from the fixing belt 610. Hence, the peeling pad nip portion N2 may be regarded as a preparation step for secure peeling in a final peeling step.

Then, since the fixing belt 610 is transported so as to wind around the peeling pad 64 in an exit of the peeling pad nip portion N2, the transport direction of the fixing belt 610 drastically changes at this exit. To be more specific, since the fixing belt 610 moves along the outer surface of the peeling pad 64, the fixing belt 610 is caused to form a large curve. For this reason, the sheet P whose adhesion to the fixing belt 610 is weakened in the peeling pad nip portion N2 is separated from the fixing belt 610 by the stiffness of the sheet P itself.

Then, the traveling direction of the sheet P separated from the fixing belt 610 is led by a peeling guide plate 69 serving as an example of a peeling guide member placed downstream of the peeling pad nip portion N2. The sheet P guided by the peeling guide plate 69 is thereafter transported toward the cooling unit 80 by an exit guide 78 serving as an example of an exit guide member and by an exit belt 79. More specifically, the peeling guide plate 69 is a member that separates the sheet P peeled off from the fixing belt 610 from the fixing belt 61 completely, and that sets a traveling direction of the sheet P. The exit guide 78 and the exit belt 79 are members that smoothly guide, toward the cooling unit 80, the sheet P for which the traveling direction is set by the peeling guide plate 69.

With the operations described above, the fixing process of the fixing unit 60 is completed.

<Description of Inside Heating Roll>

Now, the inside heating roll 612 is described in further detail.

Figure 3:
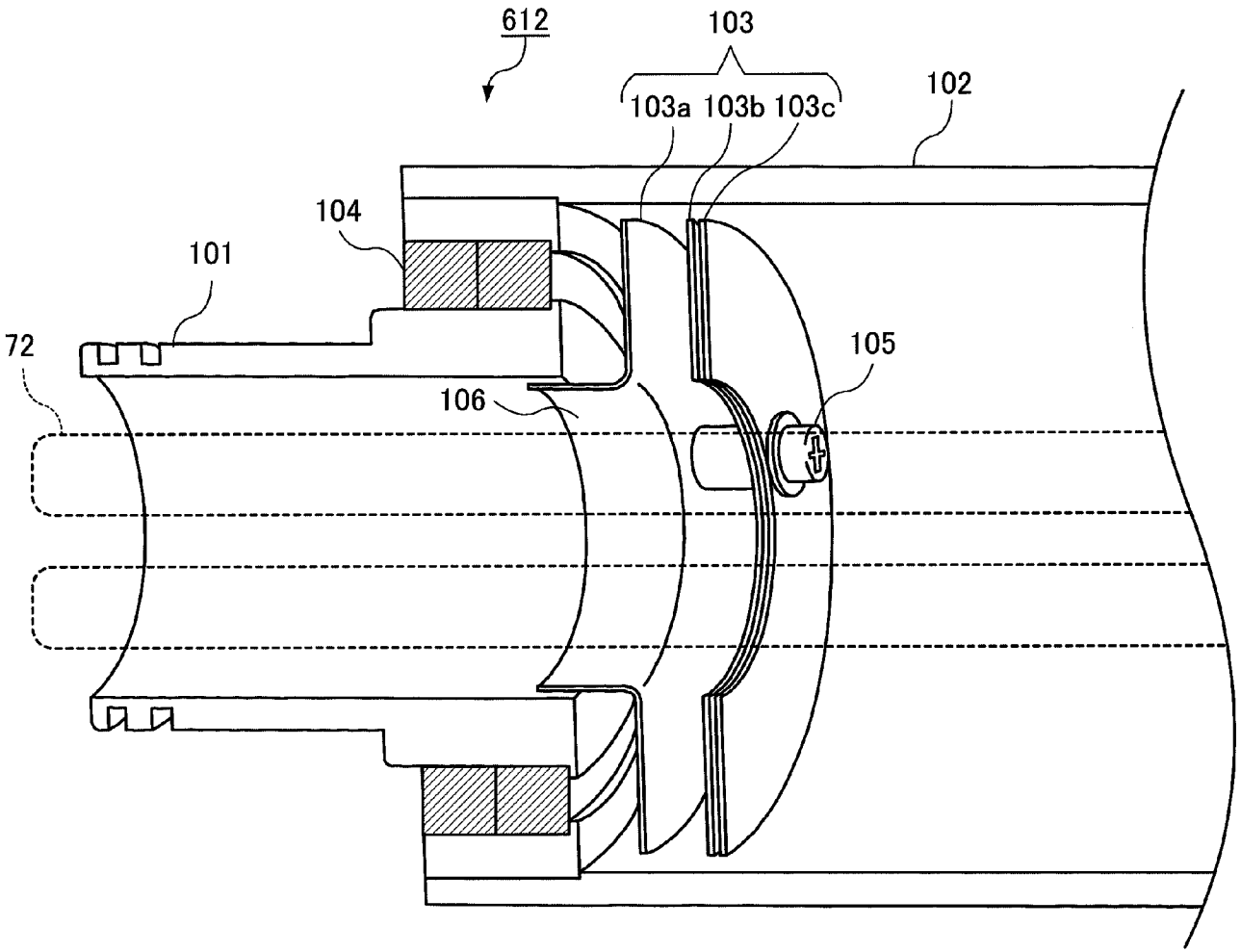
FIG. 3 is a cross-sectional view illustrating an inside heating roll.

FIG. 3 is a cross-sectional view illustrating the inside heating roll 612.

FIG. 3 shows one of end portions of the inside heating roll 612. As FIG. 3 shows, as main components, the inside heating roll 612 includes: secured center shafts 101; an outer circumferential portion 102 that rotates about the center shafts 101; the halogen heaters 72 being placed inside the outer circumferential portion 102 and serving as an example of a heater that heats the outer circumferential portion 102 from inside; and heat reflecting plates 103 being fixed to the respective center shafts 101 and placed at both end portions of the outer circumferential portion 102 and serving as an example of a heat reflecting member that reflects heat emitted from the halogen heaters 72. Note that the halogen heaters 72 are shown in dotted lines to facilitate illustration.

Each center shaft 101 is placed at a corresponding one of both end portions of the inside heating roll 612. One of the reasons why the center shaft 101 is secured not to rotate is that the inside heating roll 612 has the mechanism for controlling belt walk of the fixing belt 610 (refer to FIG. 2). Specifically, as described above, the belt walk of the fixing belt 610 is controlled by the displacement mechanism that displaces one of the end portions of the inside heating roll 612 in the direction orthogonal to the axis direction of the inside heating roll 612. Therefore, this displacement mechanism may be secured not to rotate. For this reason, the displacement mechanism is secured together with the center shaft 101 by being connected to the center shaft 101 that does not rotate.

Further, another reason why the center shaft 101 may be secured is related to the setting position of a temperature sensor (not shown) serving as an example of a heat detector for measuring the temperature of the outer circumferential portion 102. Specifically, the temperature sensor is placed in contact with the outer circumferential portion 102 in order to measure the temperature of the surface thereof. The temperature sensor may be secured by being connected to the center shaft 101.

The outer circumferential portion 102 is connected to the center shaft 101 with a bearing 104 in between. Accordingly, the bearing 104 allows the outer circumferential portion 102 to rotate about the center shaft 101. Hence, the outer circumferential portion 102 may rotate along with the rotation of the fixing belt 610.

In the exemplary embodiment, four halogen heaters 72 are placed.

Figure 4A:
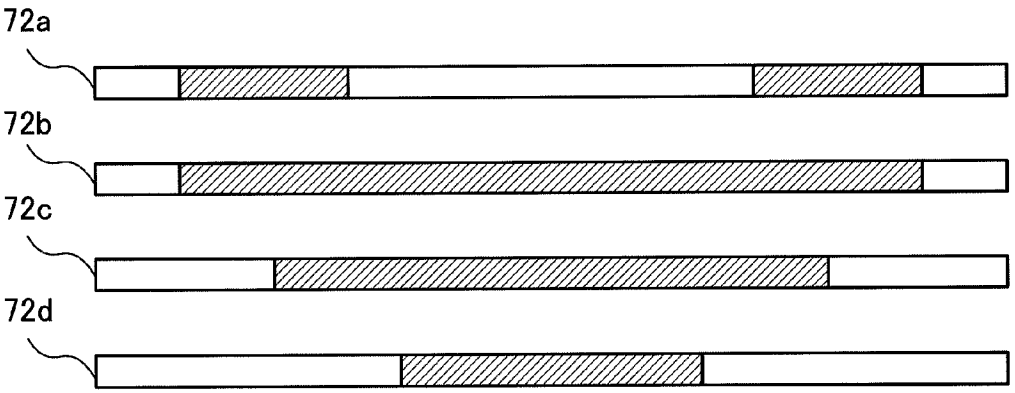
FIG. 4A illustrates locations of heat generators in four halogen heaters placed in the inside heating roll.

FIG. 4A illustrates locations of heat generators in the four halogen heaters 72 placed in the inside heating roll 612.

In FIG. 4A, shaded portions are locations of the heat generators. As FIG. 4A shows, the four halogen heaters 72, namely, halogen heaters 72*a*, 72*b*, 72*c*, and 72*d*, have different locations for the heat generators and emit heat with different patterns.

In other words, each of the halogen heaters 72*a*, 72*b*, 72*c*, and 72*d* does not emit heat from its entire body, and hardly emits heat from its both end portions. An unfixed toner image is fixed by heat from the fixing belt 610 (refer to FIG. 2) and pressure from the pressure roll 62 (refer to FIG. 2) that are applied when the sheet P passes through the nip portion N. At this time, the fixing belt 610 need not be heated in a width largely exceeding the width of the sheet P used in the image forming apparatus 1 (refer to FIG. 1). Therefore, for heating the fixing belt 610 from inside, the inside heating roll 612 is not required to heat an area exceeding a predetermined width. For this reason, the halogen heaters 72*a*, 72*b*, 72*c*, and 72*d* do not heat both end portions of the inside heating roll 612.

Here, the halogen heater 72*a* heat areas of the inside heating roll 612 that correspond to both edges of a large-size sheet P. The halogen heater 72*b* has a heat emission distribution in which an area corresponding to the width of the large-size sheet P is heated as evenly as possible. Similarly, the halogen heater 72*c* has a heat emission distribution in which an area corresponding to an intermediate-size sheet P is heated as evenly as possible, and the halogen heater 72*d* has a heat emission distribution in which an area corresponding to a small-size sheet P is heated as evenly as possible.

In the exemplary embodiment, the outputs of the four halogen heaters 72 are adjusted according to the width of the sheet P. This allows efficient heating of the fixing belt 610 according to the width of the sheet P. Specifically, after a toner image is fixed onto the sheet P, the fixing belt 610 loses heat at an area where the sheet P has passed. However, adjustment of the outputs of the four halogen heaters 72 allows the fixing belt 610 to regain an increased temperature more speedily.

Figure 4B:
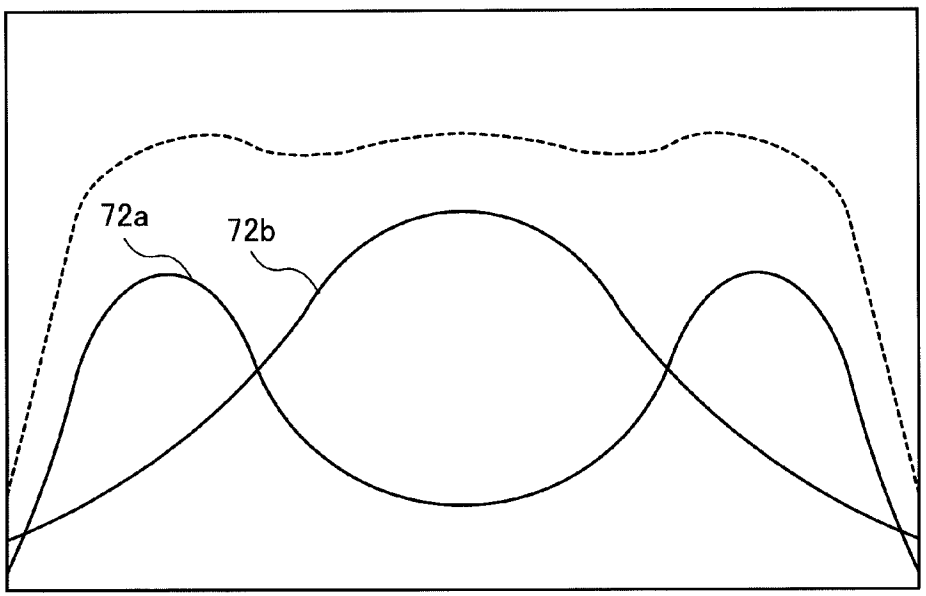
FIG. 4B illustrates a distribution of heat emitted from the halogen heaters when a large-size sheet is subjected to fixing.

FIG. 4B illustrates a distribution of heat emitted from the halogen heaters 72 when a toner image is fixed onto the large-size sheet P. In this distribution, the horizontal axis indicates a position in the halogen heaters 72 in a longitudinal axis direction thereof, and the vertical axis relatively indicates the magnitude of heat emission from the halogen heaters 72. Since the halogen heater 72*a* and the halogen heater 72*b* are used for heating the inside heating roll 612 in a case of a large-size sheet P, distributions of heat emitted from these two halogen heaters are shown in solid lines.

In this case, as FIG. 4B shows, heat emission from the halogen heater 72*a* and the halogen heater 72*b* allows an even heat emission distribution for an area corresponding to the width of the large-size sheet P. To be more specific, an area in the halogen heater 72*b* that emits heat corresponds to the width of the large-size sheet P, while the amount of heat emitted from both end portions of the heat-emitting area tend to be small. The halogen heater 72*a* emits heat for areas where the amount of heat emitted by the halogen heater 72*b* is small. A dotted line in FIG. 4B shows a total amount of the heat emission distributions of the halogen heater 72*a* and the halogen heater 72*b*. As FIG. 4B shows, the heat emission distribution is made even by using both the halogen heater 72*a* and the halogen heater 72B.

The heat reflecting plates 103 are placed at both end portions of the inside heating roll 612. In the exemplary embodiment, the heat reflecting plates 103 are secured to the respective center shafts 101 with a bolt 105 (refer to FIG. 3). The heat reflecting plates 103 are provided to prevent heat emitted from the halogen heaters 72 from being transmitted to both end portions of the inside heating roll 612. When heat emitted from the halogen heaters 72 is transmitted to both end portions of the inside heating roll 612 and excessive amount of heat reaches the bearings 104, the bearings 104 may be heated with a temperature exceeding an upper temperature limit of lubricant in the bearings 104. In the exemplary embodiment, the upper temperature limit of the lubricant in the bearings 104 is, for example, 260° C. In this case, in view of prevention of lubricant deterioration, the temperature of the bearings 104 needs to be 240° C. or less. Further, the temperature of the bearings 104 may be as lower than 240° C. as possible in view of prevention of lubricant deterioration. The heat reflecting plates 103 reflect heat emitted from the halogen heaters 72 and thus prevent an increase in the temperature of the bearings 104 and deterioration of the lubricant.

In addition, as mentioned earlier, the amount of heat emitted from both end portions of the area of the halogen heaters 72 that emit heat tend to be small. Both of those end portions are heated by providing the heat reflecting plate 103, further helping evening the heat emission distribution of the halogen heaters 72.

The position to place each of the heat reflecting plates 103 may be closer to an end portion of the inside heating roll 612 than an area where the outer circumferential portion 102 heated by the halogen heaters 72 has a peak temperature. When the heat reflecting plate 103 is placed closer to a center portion of the inside heating roll 612 than the above-mentioned position, an area heated by the halogen heaters 72 is positioned closer to the end portion than the position of the heat reflecting plate 103. In this case, the temperature of the bearing 104 is likely to increase. Accordingly, by placing the heat reflecting plate 103 at the above-described position, the temperature of the bearings 104 may be prevented from increasing.

Further, multiple pieces of the heat reflecting plate 103 may be placed at each of both end portions of the outer circumferential portion 102 in a direction of the center shaft 101. Thereby, heat emitted from the halogen heaters 72 may be reflected more efficiently.

In the example shown in FIG. 3, the heat reflecting plate 103 includes heat reflecting plates 103*a*, 103*b*, and 103*c*. Among these, the heat reflecting plate 103*a* which is positioned at the farthest end portion has an extension portion 106 formed along the center shaft 101. As described earlier, the halogen heaters 72 emit almost no heat from the end portions.

However, a small amount of heat is still emitted. By providing the extension portion 106, heat emitted from the end portion is also reflected, preventing the heat from reaching the bearing 104. Thereby, the temperature increase of the bearing 104 may be further suppressed.

EXAMPLES

Example 1

Image formation is conducted using the image forming apparatus 1 (refer to FIG. 1) employing the fixing unit 60 (refer to FIG. 2) which uses the inside heating roll 612 provided with the heat reflecting plate shown in FIG. 3. Here, the fixing roll 611 is controlled so that its surface may have a temperature of 195° C. Similarly, the inside heating roll 612 and the outside heating roll 613 are controlled so that their surfaces may have a temperature of 190° C. and 180° C., respectively.

As the sheet P, Mirror Coat Platinum (size A3 having a basis weight of 256 g/m$^2$) of Fuji Xerox Co., Ltd is used. The process for the image formation is as follows. After stand-by for about 150 seconds, image formation is performed on 250 sheets P. The time required for the image formation is about 200 seconds. Then, after the image formation, the image forming apparatus 1 returns to the stand-by state.

Under the operation conditions described above, a change in the temperature of the bearing 104 is measured. Note that the upper temperature limit of the lubricant used in the bearing 104 is 260° C. in the exemplary embodiment, but needs to be 240° C. or less in view of deterioration prevention.

Comparative Example 1

Image formation is performed under similar conditions to Example 1, except that the inside heating roll 612 shown in FIG. 3 from which the heat reflecting plate 103 is removed is used as an inside heating roll, and a change in the temperature of the bearing 104 is measured.

(Evaluation Result)

Figure 5:
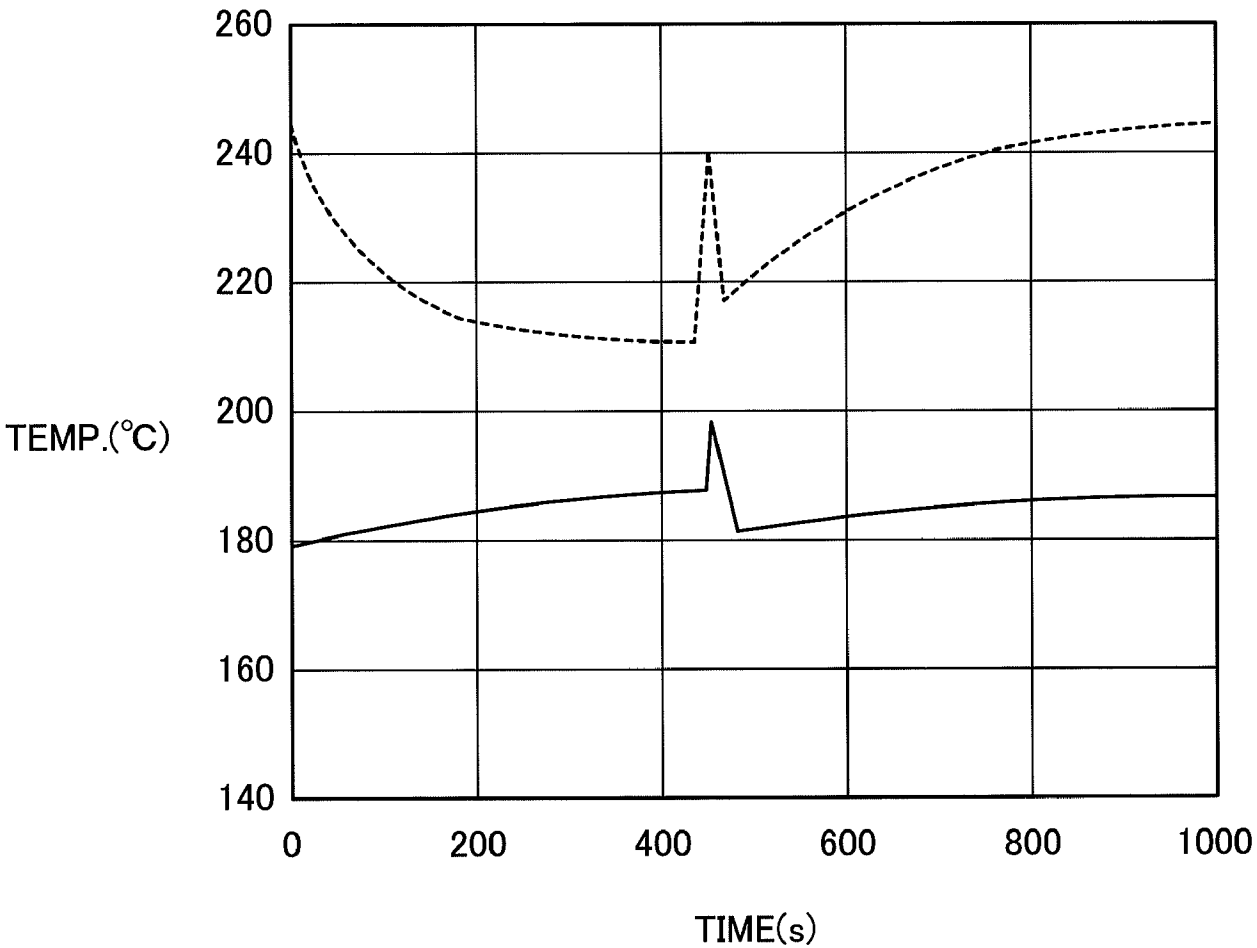
FIG. 5 shows results of Example 1 and Comparative Example 1.

FIG. 5 shows the results. In FIG. 5, the horizontal axis indicates time (s), and the vertical axis indicates the temperature (° C.) of the bearing 104. The result of Example 1 is shown in a solid line, whereas the result of Comparative Example 1 is shown in a dotted line.

As FIG. 5 shows, in the case of Example 1 where the inside heating roll 612 provided with the heat reflecting plate 103 is used, the temperature of the bearing 104 was 200° C. or less during the entire process. In contrast, in the case of Comparative Example 1 where the inside heating roll provided with no heat reflecting plate 103 is used, the temperature increases and exceeds 240° C. in the stand-by state after the image formation.

It should be noted that the image forming apparatus of the electrophotographic system is taken as an example in the exemplary embodiment, however, the image forming apparatus may employ an ink jet system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member that heats a recording medium;

a pressure member that forms a heating pressure portion between the pressure member and the heating member by coming into pressure contact with an outer circumferential surface of the heating member, the heating pressure portion being passed through by the recording medium;

a tensioning member that is placed facing the pressure member with the heating member interposed therebetween, and that provides a tension to the heating member;

and an inside heating unit that heats the heating member from inside and that controls meandering of the heating member, the inside heating unit including:

a secured center shaft;

an outer circumferential portion that rotates about the center shaft;

a heater that is placed inside the outer circumferential portion, and that heats the outer circumferential portion from inside; and a plurality of heat reflecting members, each of the plurality of heat reflecting members are secured to the center shaft and placed at each of both end portions of the outer circumferential portion, the plurality of heat reflecting members are arranged in a horizontal direction that is a same direction as a direction of the center shaft, and the plurality of heat reflecting members reflect heat emitted from the heater.

2. The heating device according to claim 1, wherein at least one of the plurality of heat reflecting members has an extension portion formed along the center shaft.

3. The heating device according to claim 2, wherein the plurality of heat reflecting members are placed closer to each of the end portions than an area where the outer circumferential portion has a peak temperature.

4. The heating device according to claim 3, further comprising a heat detector secured to the center shaft.

5. The heating device according to claim 2, further comprising a heat detector secured to the center shaft.

6. The heating device according to claim 1, wherein the plurality of heat reflecting members are placed closer to each of the end portions than an area where the outer circumferential portion has a peak temperature.

7. The heating device according to claim 6, further comprising a heat detector secured to the center shaft.

8. The heating device according to claim 1, further comprising a heat detector secured to the center shaft.

9. The heating device according to claim 1, further comprising a heating device placed in contact with the outer circumferential portion and connected to the center shaft.

10. The heating device according to claim 1, further comprising a peeling member that is placed in a region downstream of the heating pressure portion, in a direction in which the recording medium proceeds, at a position adjacent to the tensioning member, and that peels off the recording medium from the heating member.

11. An image forming apparatus comprising:

an image forming unit that forms an image;

a transfer unit that transfers the image formed by the image forming unit onto a recording medium; and a heating device including:

a heating member that heats the recording medium;

a pressure member that forms a heating pressure portion between the pressure member and the heating member by coming into pressure contact with an outer circumferential surface of the heating member, the heating pressure portion being passed through by the recording medium; a tensioning member that is placed facing the pressure member with the heating member interposed therebetween, and that provides a tension to the heating member;

and an inside heating unit that heats the heating member from inside and that controls meandering of the heating member, the inside heating unit including:

a secured center shaft;

an outer circumferential portion that rotates about the center shaft; a heater that is placed inside the outer circumferential portion, and that heats the outer circumferential portion from inside; and a plurality of heat reflecting members, each of the plurality of heat reflecting members are secured to the center shaft and placed at each of both end portions of the outer circumferential portion, the plurality of heat reflecting members are arranged in a horizontal direction that is a same direction as a direction of the center shaft, and the plurality of heat reflecting members reflect heat emitted from the heater.

12. An image forming apparatus according to claim 11, further comprising a peeling member that is placed in a region downstream of the heating pressure portion, in a direction in which the recording medium proceeds, at a position adjacent to the tensioning member, and that peels off the recording medium from the heating member.

13. A heating device comprising:

a heating member that heats a recording medium;

an inside heating unit that heats the heating member from inside, the inside heating unit including:

a secured center shaft;

an outer circumferential portion that rotates about the center shaft;

a heater that is placed inside the outer circumferential portion, and that heats the outer circumferential portion from inside; and a plurality of heat reflecting members, each of the plurality of heat reflecting members are secured to the center shaft and placed at each of both end portions of the outer circumferential portion, the plurality of heat reflecting members are arranged in a horizontal direction that is a same direction as a direction of the center shaft, and the plurality of heat reflecting members reflect heat emitted from the heater.

14. The heating device according to claim 13, wherein at least one of the plurality of heat reflecting members has an extension portion formed along the center shaft.

15. The heating device according to claim 14, wherein the plurality of heat reflecting members are placed closer to each of the end portions than an area where the outer circumferential portion has a peak temperature.

16. The heating device according to claim 13, wherein the plurality of heat reflecting members are placed closer to each of the end portions than an area where the outer circumferential portion has a peak temperature.

17. The heating device according to claim 13, further comprising a heat detector secured to the center shaft.

* * * * *